United States Patent [19]

Müller

[11] Patent Number: 4,509,939

[45] Date of Patent: Apr. 9, 1985

[54] FOLDING DEVICE FOR WEB-FED ROTARY PRINTING PRESSES

[75] Inventor: Hans Müller, Leimen, Fed. Rep. of Germany

[73] Assignee: Heidelberger Druckmaschinen AG, Heidelberg, Fed. Rep. of Germany

[21] Appl. No.: 328,008

[22] Filed: Dec. 7, 1981

[30] Foreign Application Priority Data

Dec. 6, 1980 [DE] Fed. Rep. of Germany ..... 3046051

[51] Int. Cl.[3] ..... B65H 45/18

[52] U.S. Cl. ..... 493/444; 74/52

[58] Field of Search ..... 493/444–445; 74/22 R, 22 A, 52

[56] References Cited

U.S. PATENT DOCUMENTS

| | | | |
|---|---|---|---|
| 2,309,047 | 1/1943 | Culbertson | 74/52 |
| 3,363,474 | 1/1968 | Ritter | 74/52 |
| 3,995,850 | 12/1976 | Hertrich | 493/444 |
| 4,239,201 | 12/1980 | Richter | 493/444 |

*Primary Examiner*—A. J. Heinz

*Attorney, Agent, or Firm*—Herbert L. Lerner; Laurence A. Greenberg

[57] ABSTRACT

Folding device for web-fed rotary printing presses for forming a longitudinal fold in a direction wherein printed copies are conveyed, the longitudinal fold being producible, after a cylinder-crossfold, by a folding blade disposed parallel to the conveying direction, the folding blade being suspended from two drive cranks having the same speed of rotation and being reciprocatingly movable by the latter, the folding blade, in a bottom position thereof, thrusting the printed copies between two driven folding rollers, including an additional crank disposed between the respective drive crank from which the folding blade is suspended, the respective drive crank having a crank pin and the additional crank having a trunnion, the additional crank being coaxially supported by the trunnion thereof on the crank pin of the respective drive crank, and a gear train operatively connected with the additional crank for driving the additional crank at the same rotary speed as that of the respective drive crank and in opposite rotary direction thereof so that a crank pin of the additional crank executes a vertical stroke.

7 Claims, 4 Drawing Figures

FOLDING DEVICE FOR WEB-FED ROTARY PRINTING PRESSES

The invention relates to a folding device for web-fed rotary printing presses for forming a longitudinal or former fold in printed copies extending in the direction in which the printed copies are conveyed, the longitudinal fold being produced, after a cylinder-crossfold, by a folding blade disposed parallel to the conveying direction, the folding blade being suspended from two drive cranks having the same speed or rotation and being reciprocatingly moved by the latter and, in a bottom position thereof, thrusting the printed copies between two driven folding rollers.

In a device of this general type disclosed in German Published Non-Prosecuted Application (DE-OS) No. 28 15 077, there is sought to produce a longitudinal fold in displaced printed copies without misaligning the copies. The proposed method in this known disclosure is that, as the folding blade goes down, both folding rollers perform a movement in the original conveying direction of the printed copies. The required mechanical outlay e.g. for controlling the axial movement of the two folding rollers, for the axially movable mounting and for the special drive of the rollers, is considerable. A further marked disadvantage of the known construction is that the rollers have to be moved back again into the original position thereof during the folding operation so that, at high press speeds, it is impossible to prevent jerky movement of the folding rollers and, consequently, of the folded copy with the result that the latter may incur damage, particularly in the case wherein a low number of pages are involved.

Assuming that the belt-fed copies being conveyed are in an inclined position determined by the conveyor and can only be aligned again at right angles to the folding edge by means of front stops, then the aforementioned known construction does not disclose any possibility of how to carry out such alignment. Thus, the aforedescribed heretofore known construction is not suitable for high speeds and does not ensure an exact right-angled fold if the copies are supplied in an inclined position.

It is accordingly an object of the invention to provide a folding device rotating at high speed for forming a longitudinal fold without any sliding, return-motion guide components, wherein, during the folding operation the folding blade performs a vertical stroke movement in either direction to the printed copy.

With the foregoing and other objects in view, there is provided, in accordance with the invention, a folding device for web-fed rotary printing presses for forming a longitudinal fold in a direction wherein printed copies are conveyed, the longitudinal fold being producible, after a cylinder-crossfold, by a folding blade disposed parallel to the conveying direction, the folding blade being suspended from two drive cranks having the same speed of rotation and being reciprocatingly movable by the latter, the folding blade, in a bottom position thereof, thrusting the printed copies between two driven folding rollers, including an additional crank disposed between the respective drive crank from which the folding blade is suspended, the respective drive crank having a crank pin and the additional crank having a trunnion, the additional crank being coaxially supported by the trunnion thereof on the crank pin of the respective drive crank, and a gear train operatively connected with the additional crank for driving the additional crank at the same rotary speed as that of the respective drive crank and in opposite rotary direction thereof so that a crank pin of the additional crank executes a vertical stroke.

The advantage of the foregoing construction according to the invention is that the folding blade brakes the speed of the copies and then thrusts them vertically between the folding rollers so that the copy is not affected by any lateral sliding movement directed in any direction, which can cause skewing or a laterally displaced fold. This occurs independently of the operating speed of the press, whereby the copies can be aligned at right angles in a conventional manner. Furthermore, the folding device according to the invention operates purely by rotation without any sliding or return-motion parts In accordance with another feature of the invention, the drive crank has a drive pin, a fixed internal toothing disposed concentrically to the drive pin, a gearwheel carried by the trunnion of the additional crank and rollingly meshing with the internal toothing so that the vertical stroke executed by the crank pin of the additional crank is a rectilinear, vertical reciprocating movement.

In accordance with a further feature of the invention, the drive crank has a drive pin, a fixed externally toothed sun gear disposed concentrically to the drive pin, a spur gear carried by the trunnion of the additional crank and rollingly meshing with the external toothing of the sun gear so that the vertical stroke executed by the crank pin of the additional crank is a rectilinear, vertical reciprocating movement.

In accordance with an additional feature of the invention, the drive crank has a crank radius corresponding to the crank radius of the additional crank, and the gearwheel carried by the trunnion of the additional crank has a diameter corresponding to twice the crank radius of the additional crank, the drive pin of the drive crank being rotatable one revolution per folding cycle.

In accordance with an added feature of the invention, the drive crank and the additional crank have respective radii of equal length, and the spur gear supported on the trunnion of the additional crank has a diameter one-half that the diameter of the fixed sun gear, the drive pin of the drive crank being rotatable one revolution per folding cycle.

In accordance with yet another feature of the invention, each of the drive cranks has a drive pin, and there is provided a spur gear coupling the drive pins, the drive pins having a phase relationship adjustable with respect to the copies being folded.

In accordance with a concomitant feature of the invention, there are provided respective counterweights carried by the respective drive crank and the additional crank opposite the respective crank pins thereof.

Other features which are considered as characteristic for the invention are set forth in the appended claim.

Although the invention is illustrated and described herein as embodied in a folding device for web-fed rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings in which.

Figure 1:
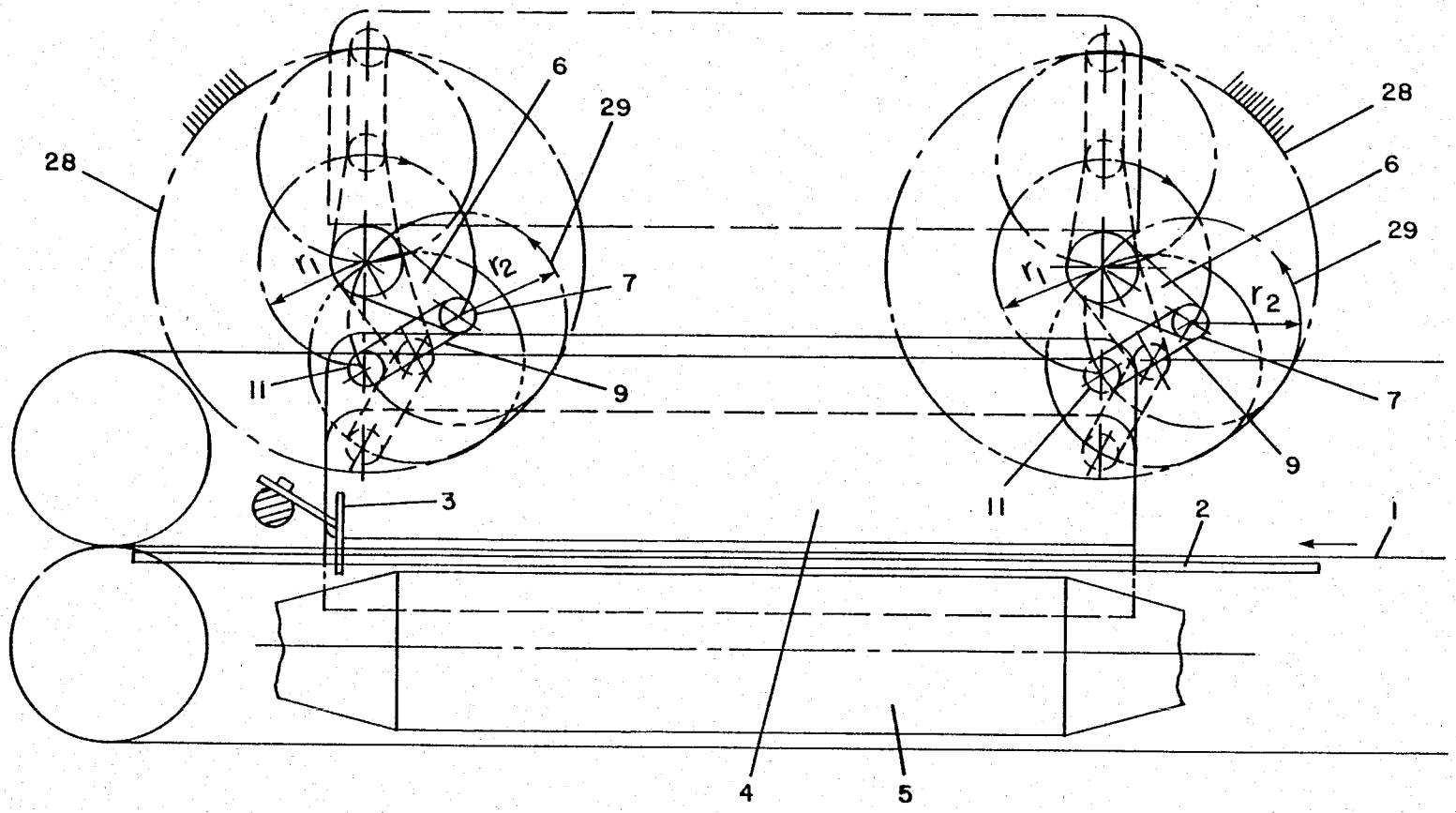
FIG. 1 is a diagrammatic side elevational view of the folding device according to the invention.

Referring now to the drawing and first, particularly to FIG. 1 thereof, there is shown how a printed copy to be folded is transported in a conventional manner via a strip line or conveyor belt 1 over a folding table 2 to stops 3 and immediately after gentle contact with the latter for effecting alingment thereof, is thrust by a folding blade 4 between folding rollers 5 which then transport the copy away downwardly. The timing of impact of the folding blade and, consequently, the instant of folding is adjustable in a conventional manner e.g. by varying the phase position of the folding blade with respect to the copy to be folded.

The reciprocating movement of the folding blade 4 is produced by two drive cranks 6 (FIG. 1) on the crank pins 7 of which there is mounted a trunnion 8 (FIG. 2) of an additional crank 9. As further shown in FIG. 2, the folding blade 4 is mounted in ball bearings 10 on the crank pin 11 of the additional crank 9. The additional crank 9 bears a counterweight 12 for mechanical balancing or mass balancing.

Fastened onto the trunnion 8 of the additional crank 9 is a gearwheel 13 which is mounted on the crank pin by means of a ball bearing 14. The trunnion 8 is also mounted by means of a ball bearing 15 in a counterbearing 16 which is fastened by means of bolts 17 to the rotating body 18 of the drive crank 6. The counterbearing 16 is, in turn, disposed concentrically or coaxially with the drive pin 19 of the drive crank 6 and is mounted by means of a ball bearing 20 in a bearing holder 21 which is, in turn, fastened to the support 22. A counterweight 23 for mass balancing is also fastened in the counterbearing 16.

Figure 2:
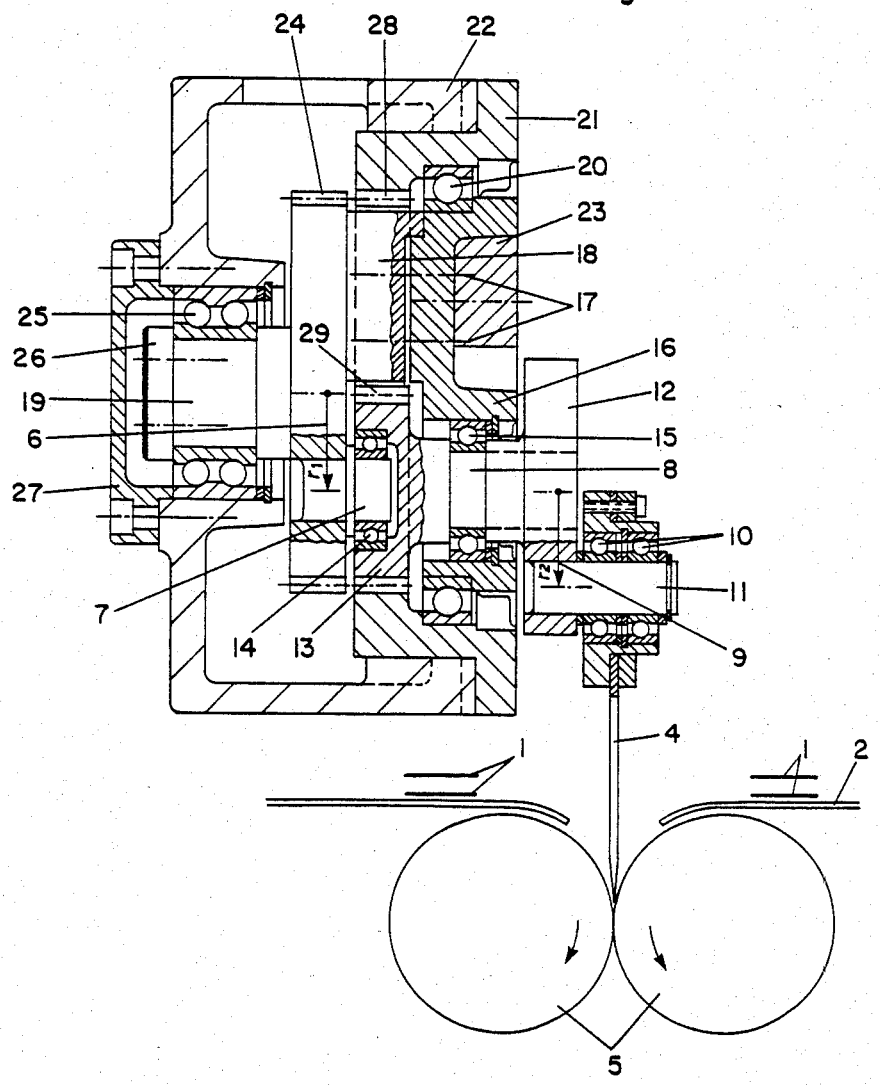
FIG. 2 is a fragmentary cross-sectional view of the folding blade control mechanism forming part of the invention.

In the embodiment of the invention shown in FIG. 2, the drive crank 6 has the form of a drive wheel 24 which is likewise mounted in the support 22 by means of the drive pin 19 and a second ball bearing 25. The ball bearing 25 is held in position laterally by the disc 26 and the cover 27.

When the drive wheel 24 is set in rotation, the crank pin 7 of the drive crank 6 in conjunction with the counterbearing 16 and the ball bearing 15 drives the gearwheel 13 in a manner that it rolls around in the internal toothing 28 in the bearing holder 21. In the illustrated embodiment of FIG. 2, the internal toothing 28 has twice the diameter of the toothing 29 of the gearwheel 13. Furthermore, in the embodiment shown, the crank radii of the drive crank 6 and the additional crank 9 correspond to the radius of the toothing 29. The rotary movement of the gearwheel 13 is opposite in direction to the rotary movement of the drive wheel 24.

In FIG. 1, the drive crank 6 moves in a clockwise direction (arrow) and the additional crank 9 in an anticlockwise or counterclockwise direction. In the position of the folding blade 4 shown in solid lines, it is a slight distance above the folding table 2. Following the rotational movement of the drive crank 6, the next position shown by the broken line is just before bottom dead center i.e. that instant immediately before the copy is gripped by the folding rollers. Also shown in FIG. 1 by a broken line are the top dead center positions of the drive cranks 6 and the additional crank 9. In the illustrated construction of the folding device, the total stroke of the folding blade 4 thus corresponds precisely to the pitch diameter of the internal toothing 28. With these transmission ratios, the crank pin 11 of the additional crank 9 moves precisely vertically rectilinearly and concentrically or coaxially to the drive pin 19. Consequently, the folding blade 4 also performs a rectilinear, vertical reciprocating movement. This is the case when the crank radius $r_1$ of the drive crank 6 corresponds to the crank radius $r_2$ of the additional crank 9. In the illustrated embodiment the drive crank 6 performs one revolution per folding cycle.

Figure 3:
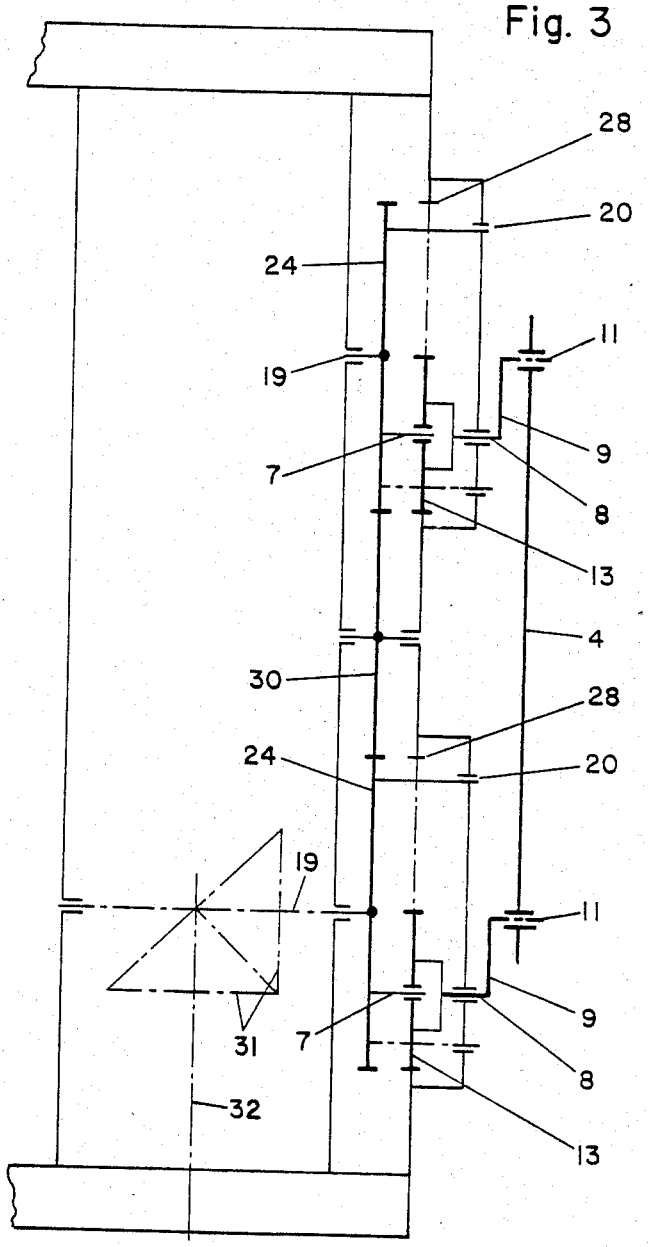
FIG. 3 is a schematic top plan view of the drive for the folding device.

In the schematic view of FIG. 3, the two drive wheels 24 are coupled by means of a spur gear 30. The lower drive pin 19 is coupled by means of a bevel gear pair 31 to a drive shaft 32, the phase position of which can be varied e.g. by means of a helical gear. The folding blade 4 thereby adjustable with respect to the copy to be folded so that it is possible to set precisely the instant or timing of folding and thus also the instant of impact or engagement of the copy with the stops 3.

Figure 4:
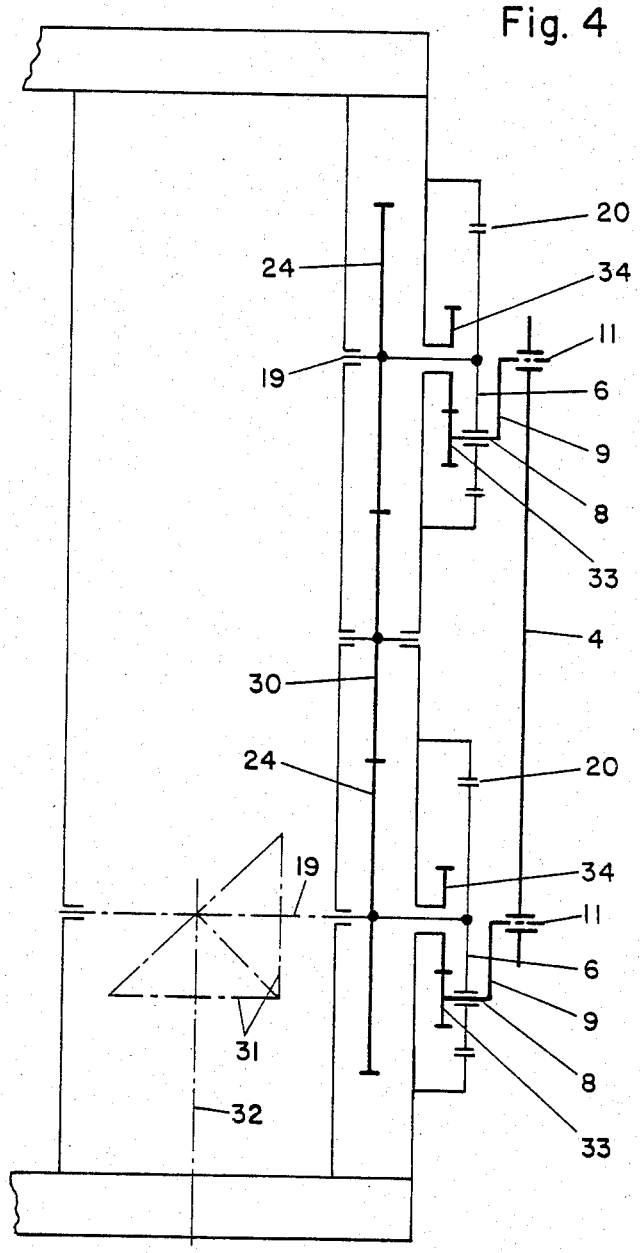
FIG. 4 is a view similar to that of FIG. 3, which is a top view of an alternative drive.

The schematic diagram shown in FIG. 4 differs from the previously described construction in that a spur gear 33 on the trunnion 8 of the additional crank 9 meshes with a non-rotating, externally toothed sun gear 34 during the rotational movement of the drive crank 6. The suspension of the folding blade 4 and the rectilinear, vertical reciprocating movement of the latter are not thereby changed.

The foregoing is a description corresponding to German Application No. P 30 46 051.6, dated Dec. 6, 1980, International priority of which is being claimed for the instant application, and which is hereby made part of this application. Any discrepancies between the foregoing specification and the aforementioned corresponding German Application are to be resolved in favor of the latter.

What is claimed is:

1. Folding device for web-fed rotary printing presses for forming a longitudinal fold in a direction wherein printed copies are conveyed, the longitudinal fold being producible, after a cylinder-crossfold, by an elongated folding blade disposed parallel to the conveying direction, the folding blade being suspended at opposite ends thereof from two drive cranks which are driven at the same speed of rotation and reciprocatingly movable by the latter; the folding blade, in a bottom position thereof, thrusting the printed copies between two driven folding rollers, the folding device comprising a respective additional crank suspending the folding blade at a respective end thereof from each of the drive cranks, each of the drive cranks having a crank pin and said additional crank, respectively, having a trunnion, said additional crank being supported by said trunnion thereof on and coaxial to said crank pin of the respective drive crank, and a gear train operatively connected with said additional crank for driving said additional crank at the same rotary speed as that of the respective drive crank and in opposite rotary direction thereof so that a crank pin of said additional crank suspending the respective end of the folding blade executes a vertical stroke moving the respective end of the folding blade in the same direction.

2. Folding device according to claim 1, wherein the drive crank has a drive pin, a fixed internal toothing disposed concentrically to said drive pin, a gearwheel carried by said trunnion of said additional crank and rollingly meshing with said internal toothing so that the vertical stroke executed by said crank pin of said additional crank is a rectilinear, vertical reciprocating movement.

3. Folding device according to claim 2, wherein said drive crank has a crank radius corresponding to the crank radius of said additional crank, and said gearwheel carried by said trunnion of said additional crank has a diameter corresponding to twice said crank radius of said additional crank said drive pin of the drive crank being rotatable one revolution per folding cycle.

4. Folding device according to claim 1, wherein the drive crank has a drive pin, a fixed externally toothed sun gear disposed concentrically to said drive pin, a spur gear carried by said trunnion of said additional crank and rollingly meshing with the external toothing of said sun gear so that the vertical stroke executed by said crank pin of said additional crank is a rectilinear, vertical reciprocating movement.

5. Folding device according to claim 4, wherein the drive crank and said additional crank have respective radii of equal length, and said spur gear supported on said trunnion of said additional crank has a diameter one-half that the diameter of said fixed sun gear, said drive pin of the drive crank being rotatable one revolution per folding cycle.

6. Folding device according to claim 1, wherein each of the drive cranks has a drive pin, and including a spur gear coupling said drive pins, said drive pins having a phase relationship adjustable with respect to the copies being folded.

7. Folding device according to claim 1, including respective counterweights carried by the respective drive crank and said additional crank opposite the respective crank pins thereof.

* * * * *